US007997444B2

(12) United States Patent
Martins

(10) Patent No.: US 7,997,444 B2
(45) Date of Patent: Aug. 16, 2011

(54) DISPENSING PACKAGE

(75) Inventor: Ricardo Martins, Rio de Janeiro (BR)

(73) Assignee: SR Pack Ind. Comercio LTDA, Rio de Janeiro (BR)

( * ) Notice: Subject to any disclaimer, the term of this patent is extended or adjusted under 35 U.S.C. 154(b) by 0 days.

(21) Appl. No.: 11/873,857

(22) Filed: Oct. 17, 2007

(65) Prior Publication Data

US 2008/0093374 A1 Apr. 24, 2008

(30) Foreign Application Priority Data

Oct. 20, 2006 (BR) ..... 0604326

(51) Int. Cl.
*B65D 43/16* (2006.01)
*B65D 83/00* (2006.01)

(52) U.S. Cl. ..... 221/63; 221/303

(58) Field of Classification Search ..... 220/810; 221/22, 23, 25–29, 31–34, 36, 38, 40–65, 221/70, 71, 73, 74, 81, 83, 122, 173, 182, 221/191, 193, 199, 203, 208, 216, 222–224, 221/228, 229, 231, 237, 240, 255, 256, 257, 221/282, 285, 290, 293, 303, 306, 309, 311
See application file for complete search history.

(56) References Cited

U.S. PATENT DOCUMENTS

| | | | | | |
|---|---|---|---|---|---|
| 3,002,668 | A * | 10/1961 | Castelli | 225/52 |
| 3,843,017 | A * | 10/1974 | Harrison | 221/63 |
| D254,898 | S * | 5/1980 | Buerk | D6/518 |
| 4,706,843 | A * | 11/1987 | Thornton | 221/48 |
| 5,167,377 | A * | 12/1992 | Chalmers | 225/46 |
| 5,607,050 | A * | 3/1997 | Dolan et al. | 206/63.5 |
| 6,158,614 | A * | 12/2000 | Haines et al. | 221/63 |
| 6,409,044 | B1 * | 6/2002 | Brown et al. | 221/63 |
| 7,143,906 | B2 * | 12/2006 | Chasid et al. | 221/45 |
| 7,178,690 | B2 * | 2/2007 | Chasid et al. | 221/62 |
| 7,255,254 | B2 * | 8/2007 | Tan | 225/39 |
| 7,354,598 | B2 * | 4/2008 | Masting | 424/443 |
| 2003/0029881 | A1 * | 2/2003 | Trunsky | 221/45 |
| 2004/0084469 | A1 * | 5/2004 | Tu | 221/33 |
| 2005/0061826 | A1 * | 3/2005 | Long et al. | 221/33 |
| 2005/0173448 | A1 * | 8/2005 | Dooley | 221/63 |
| 2005/0205594 | A1 * | 9/2005 | Evans et al. | 221/63 |
| 2005/0230408 | A1 * | 10/2005 | Seager | 221/45 |
| 2006/0118061 | A1 * | 6/2006 | Edwards | 119/795 |
| 2006/0118569 | A1 * | 6/2006 | Edwards | 221/63 |
| 2006/0118588 | A1 * | 6/2006 | Edwards | 225/6 |

FOREIGN PATENT DOCUMENTS

| | | | |
|---|---|---|---|
| BR | MU76006921 | U | 3/1997 |
| BR | PI99057123 | A | 7/2001 |
| BR | PI01003364 | A | 9/2002 |
| BR | MU83016880 | U | 3/2005 |

* cited by examiner

*Primary Examiner* — Gene Crawford
*Assistant Examiner* — Kelvin L Randall, Jr.
(74) *Attorney, Agent, or Firm* — McGarry Bair PC

(57) ABSTRACT

The present invention refers to a portable dispensing package comprising a pair of longitudinally opposite end walls disposed in spaced apart relation by an adjacent peripheral wall therebetween, an opening arranged on one of said end walls and a hinged lid for distributing and storing a continuous band of detachable plastic bags.

13 Claims, 3 Drawing Sheets

DISPENSING PACKAGE

CROSS-REFERENCE TO RELATED APPLICATION

This application claims the benefit of Brazilian Patent Application No. PI0604326-7, filed Oct. 20, 2006, which is incorporated herein by reference in its entirety.

FIELD OF THE INVENTION

The present invention relates generally to dispensing packages for dispensing a continuous band of material, more particular to a portable package for distributing and storing a continuous band of detachable plastic bags delimited in longitudinal direction by spaced-apart parallel transverse weakened lines.

DISCUSSION OF THE RELATED ART

Dispensing packages for distributing and storing flexible flat like items like non-woven wet wipes, tissues and other similar ones disposed either in a foldable manner or wound on a spool are well known in the state of the art.

BRMU7600692-1 patent application of 25 Mar. 1996 discloses a disposable package for distributing and storing a continuous band of paper tissues which is wound on a spool. The spool is placed inside square like boxes of variable sizes with a central opening on the top and which is covered by an adhesive tape. The rear side of the tape is also glued to an end portion of the spool so that upon pulling out the tape a portion of the continuous band is and remains exposed to the external ambient atmosphere. There is no citation of any mounting means or guiding means to ensure that the whole length of the continuous band can be taken out of the packages without any impediment. The package remains open. The continuous band is unwound from the core of the spool which is located underneath the opening. The opening is of small size and surrounded by a cover portion which acts as a barrier for the peripheral turns of the continuous band. This gives rise to increasing friction forces due to the misalignment of the tip of the continuous band with respect to the opening impairing the use of the package.

BRPI9905712-3 patent application of Aug. 12, 1999 discloses a lid for a wet wipes dispensing package comprising an upper wall (22), an opening (25) arranged on said upper wall, the opening shows a decreasing pathway converging to a straight slit (26). A cutting blade (30) is arranged near the straight slit. A portion of the continuous band is secured in the slit and an adjacent portion of said band is severed upon pressing said portion with the fingers against the cutting blade. According to the specification on page 5 lines 15 thereon the opening converges to a narrow slit towards which a portion of the continuous wet wipe must be guided. Accordingly, this prior art dispensing package requires that a portion of the band is held in the strait slit and severed by a cutting blade not being suitable for plastic bags wound on a spool. This prior art fails to reveal internal means for placing the spool of the continuous band which are necessary to enable the full removal or use of the continuous band inside the package.

BRPI0100336-4 of 17 Jan. 2001 claims a flexible package designed to contain wet wipes which resembles a sachet with two opposite planar sides and a centrally located oblong shaped opening which is arranged within a frame with a hinged lid on one side thereof. Wet wipes seem to be folded or placed within the package in a way other than wound on a spool. This state of the art document lacks any citation addressing a possible internal means for preventing the clogging of the wet wipes in the small opening. This dispenser package is not suitable for dispensing plastic bags wound on a spool which needs a positioning means to ensure that the last run of plastic bag wound on the spool is delivered by the package. Summing up this state of the art publication lacks also the necessary information regarding the internal means which cooperate with the supply of the item contained in the package.

BRMU8301688-0 utility model application of 16 Jul. 2003 is another prior art publication which claims a dispensing package for distributing and storing a continuous band of packages articulated by a transversal weakened line the dispenser embodying a tube with detachable longitudinally opposite closed end walls and a large opening arranged on the peripheral wall that resembles a window. The window has no closing means whereby the continuous band remains exposed to ambient atmosphere and contamination.

BRMU8500363-8 is a recent utility model publication of the state of the art directed to a portable dispensing package similar to the package in BRMU8301688-0 but of pentagon transversal cross section. The package is made of a flexible packing cardboard with a detachable opening delimited by continuous weakened line and arranged in a longitudinal central region on the intersection of two adjacent longitudinal sides. As all the aforementioned packages of the state of the art this also lacks any suggestion regarding a mounting means inside the package ensuring an obstruction-free and continuous sampling of the continuous band until the end is reached. Accordingly there is still a need for a portable dispensing package for distributing and storing a continuous band of flexible material capable of overcoming the aforementioned drawbacks of the state of the art.

SUMMARY OF THE INVENTION

Diverging from the state of the art the dispensing package for distributing and storing a continuous band of material of the present invention comprises a tubular casing with a closed peripheral wall and a pair of opposite end walls disposed in spaced-apart relation by said adjacent peripheral wall therebetween, said end walls and said peripheral wall delimiting an inner space for storing a spool of continuous band of material. An opening for distributing said continuous band of material with a hinged lid is arranged on one of said end walls. A projection portion is arranged on the inner side of said one end wall which protrudes inwardly. The spool comprises a hub onto which said continuous band of material is wound and which one end thereof is placed on said projection portion. This maintains the spool hub away from said opening and ensures that only the end portion of the external layer of the spool is pulled out without friction through said opening. The projection portion may comprise a bearing, a sleeve or a stem portion for receiving an end of said spool hub.

Preferably, the opening is shaped substantially like a semicircle with rounded edges. The outer edge extends parallel to the peripheral wall. Said edges are arranged substantially in concentric relation with respect to the axis of the package and converge to respective round end distal portions. This enables the output of the continuous band at any desirable angle with respect to the lid.

These and other aspects and features of the present invention will now become apparent to those of ordinary skill in the art upon review of the following description of the preferred embodiment of the invention in conjunction with the accompanying drawings.

BRIEF DESCRIPTION OF THE DRAWINGS

A detailed description of an exemplary embodiment of the present invention is provided herein below with reference to the following drawings, in which.

DETAILED DESCRIPTION OF THE PREFERRED EMBODIMENT

Figure 1:
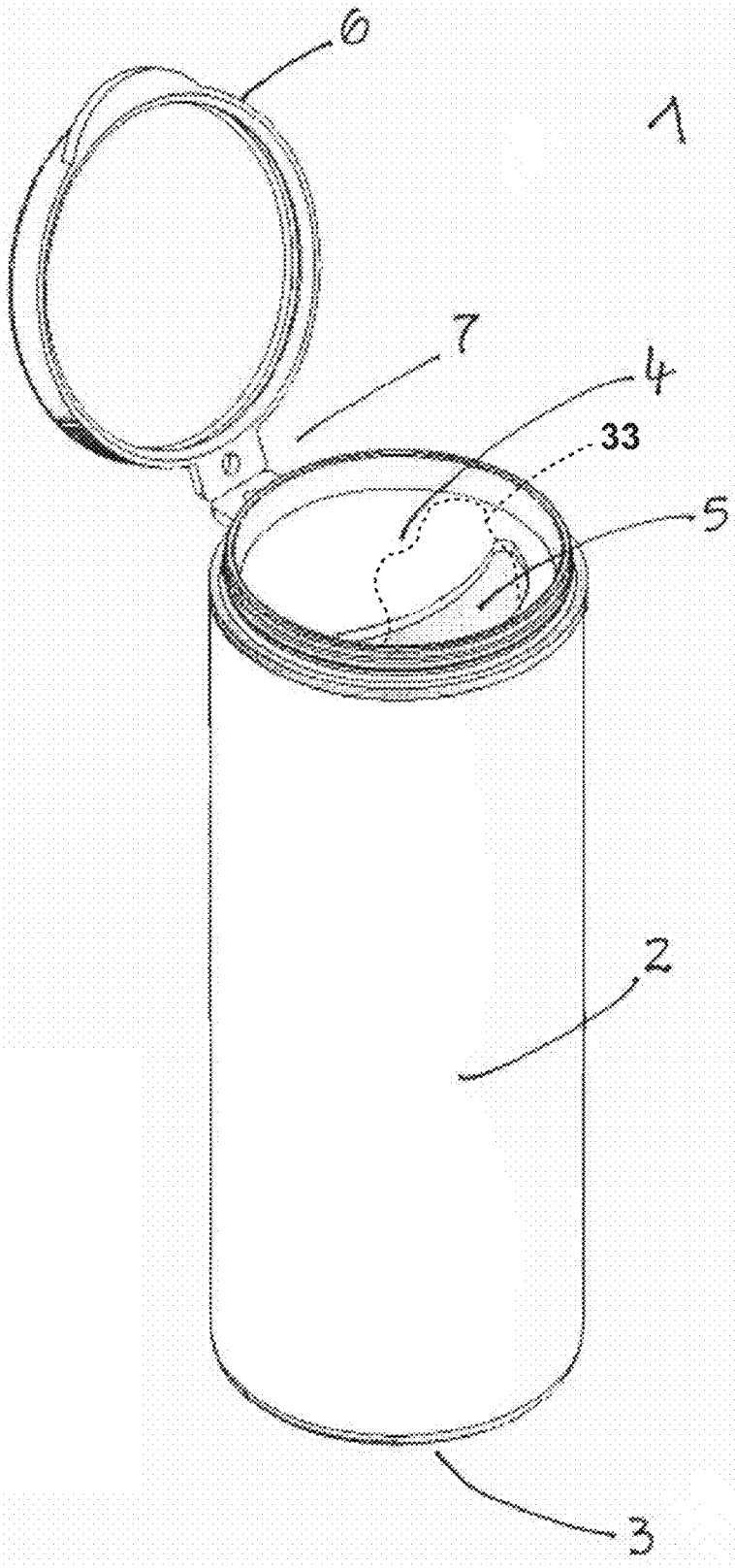
FIG. 1 is a perspective view of the dispensing package.

Shown in FIG. 1 is a dispensing package 1 of tubular shape comprising a peripheral wall 2, a first adjacent end wall defining the base 3 and the other distal opposite end wall adjacent to said peripheral wall defining the top or top 4 on which an opening 5 and a hinged lid 6 by a hinge 7 are arranged for respectively closing and opening an inner space 8 which is delimited by said peripheral wall and the adjacent pair of opposite end walls 3,4. The inner space 8 is intended to store a spool of a continuous band of material wound to a spool.

Figures 2, 3:
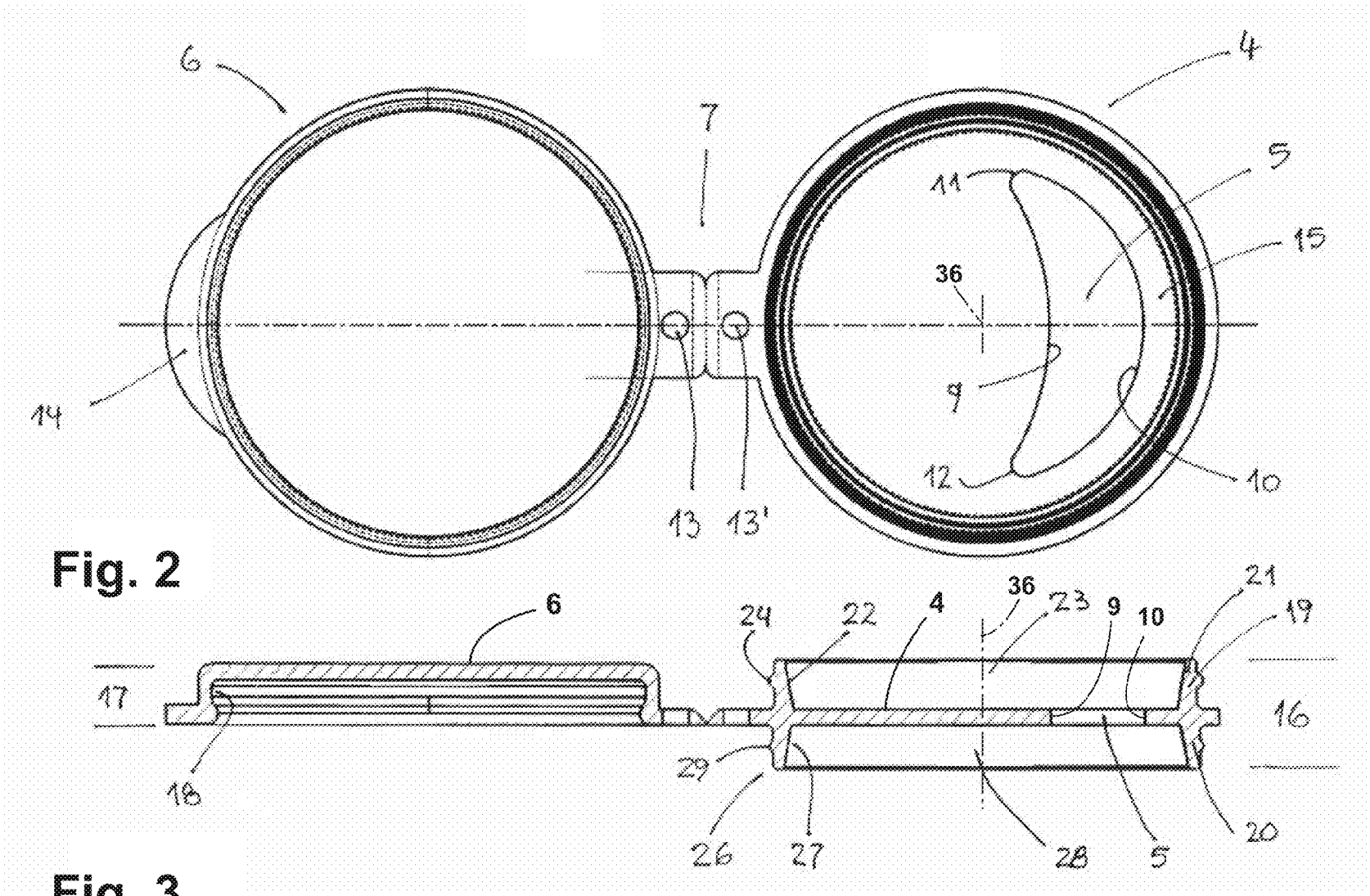
FIG. 2 is a top plan view of the upper end wall or top of the dispensing package with a hinged lid.
FIG. 3 is a transversal cross-section view of the upper end wall of FIG. 2.

Shown in FIG. 2 is the upper end wall or top 4 of the dispensing package provided with an articulated lid 6 by means of hinge 7 on which opposing bores 13, 13' are respectively arranged on each side of hinge 7 for fixing a seal or they can be used for other purposes. A flap 14 on lid 6 serves for the opening and closing of the package. As is better shown in FIG. 2, the shape of opening 5 resembles the shape of a declining moon phase. Opening 5 is longitudinally delimited by a pair of rounded edges 9 and 10 of different radius of curvature with opposite distal ends converging to respective round end portions 11 and 12. As shown in FIG. 2, outer edge 10 extends parallel to peripheral wall 2 with same radius of curvature thereby delimiting therebetween a circular wall portion 15 of constant width. The inwardly located edge 9 is slightly curved and substantially offset from the central axis 36 of the package. It is strongly preferred that opening 5 extends over a circumferential area of about ⅓ of the total circumferential area of the upper or top region 4. This provides for a controlled delivery of a desired length of the continuous band of the material located inside the dispensing device without getting stuck at the distal end portions 11,12 while it also prevents the undesired accumulation of the band of material that happens with the dispensing devices of the state of the art.

As shown in the transversal cross-section view of FIG. 3, hinge-connected upper end wall or cover 4 and lid 6 are of different height respectively indicated by 16 and 17 and both are provided with engaging means 24, 29, and 18 arranged around the periphery of said respective top 4 and on inner rim of said lid 6 which provide for a snap action closure of the dispensing device. Cover 4 is of symmetric transversal shape with a planar wall 26 delimiting on respective sides thereof opposite inwardly and outwardly oriented areas 23 and 28 which are in communication through opening 5 and delimited by respective skirt portions 19 and 20.

Skirt 19 comprises a wall portion 21 of frusto-conical configuration with a smooth inner side 22 that intersects the adjacent planar wall 26 thereby both delimiting a region 23 facing the inner space of the dispensing package 1 when mounted. For this purpose an annular boss 24 is arranged on the external side of wall portion 21 for engaging a complementary groove 25 located on the inner side of the peripheral wall 2 of the dispensing package.

Skirt 20 on the opposite side comprises a wall portion 20 of frusto-conical shape with a smooth inner side 22 that also intersects the adjacent dividing wall 26 thereby delimiting a region 28 which will be covered by lid 6 and which communicates through opening 5 with the inside of the dispensing package 1. The engaging means on lid 6 comprises an internal circumferential groove 18 which presses against boss 29 located on the periphery of skirt 20 providing for a close fitting of lid 6 on the top 4.

Figure 4:
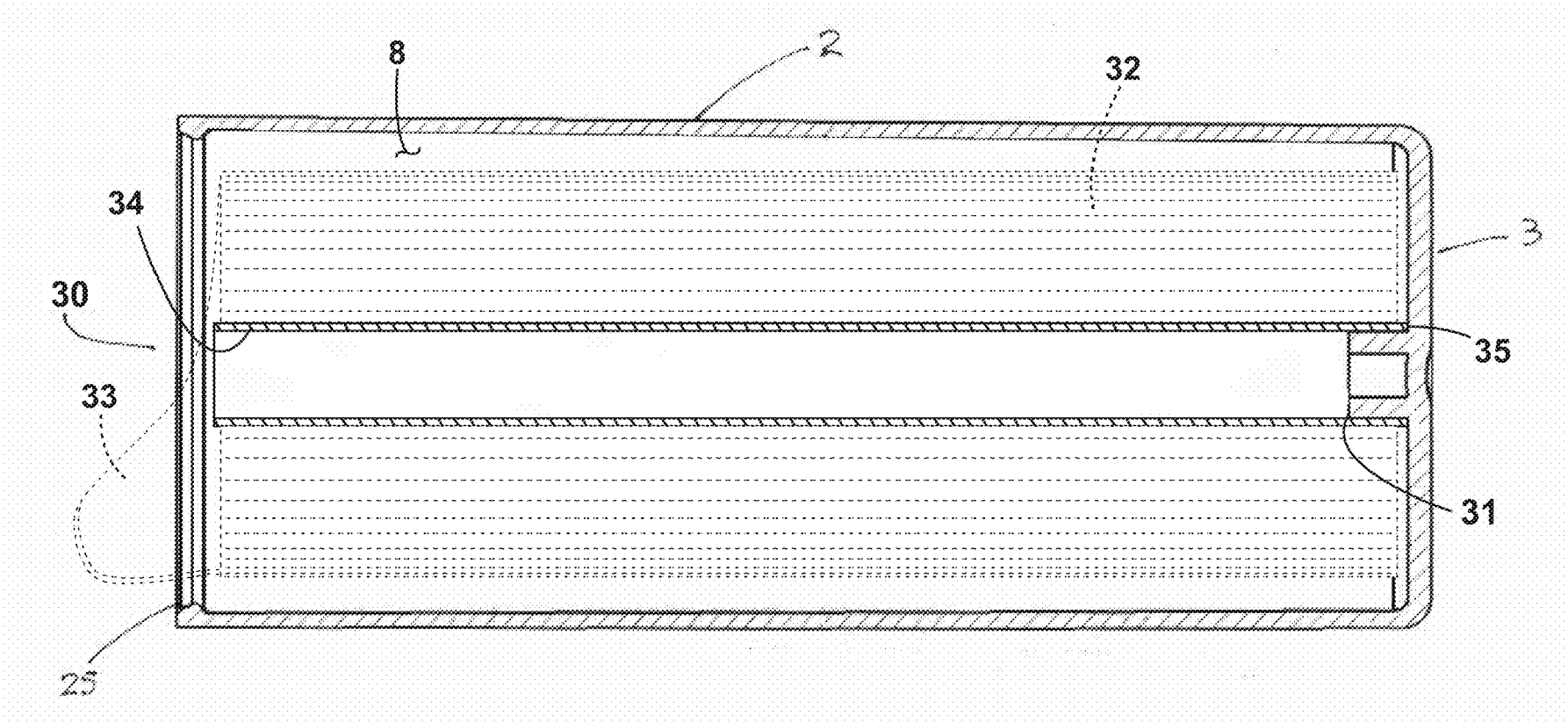
FIG. 4 is a longitudinal cross-section view of the body of the dispensing package.

As shown in the longitudinal cross section view of FIG. 4, the body of the portable dispensing package comprises a tube made in a single piece of a plastic material with peripheral wall 2, a closed end defining base 3 and located longitudinally opposite to base 3 the top open end indicated by 30 with an adjacent groove 25 arranged on the inner side of the peripheral wall 2 for a snap action coupling with the aforesaid annular boss 24 arranged on cover 4. According to the present embodiment a sleeve 31 protrudes inwardly from base 3 although it can alternatively be located on the opposite side on cover 4. It should be noted that sleeve 31 is the only one mounting element onto which a spool 34 of a continuous band of material 32 is mounted for free rotation while a tip portion 33 of the continuous band is pulled out through the opening 5 located on the longitudinally opposite end.

As initially described, the package of the present invention is designed to store a continuous band of material in a dust- and watertight manner and making it possible to withdraw portions of a continuous band 32 like the plastic bags given by way of example. As known in the art, the continuous band of material comprises in longitudinal direction a sequence of spaced-apart parallel transverse weakened lines delimiting detachable portions. According to the preferred embodiment, said portions are plastic bags which are detachable by weakened lines. The continuous band of material 32 is wound on the spool 34 which is placed inside the package with one of its longitudinally ends 35 mounted for free rotation onto and about sleeve 31, the other end in substantial abutment with the inner side of cover 4, and the tip portion 33 of the band placed in chamber 28 delimited by the dividing wall 26, the rear side of lid 6 and the adjacent surrounding wall 27.

As derived from the figures and the accompanying description the dispensing package offers advantages over the dispensing packages known in the art. One basic advantage is tightness e.g. dust-and watertight due to the snap action closure when lid 6 is shrunk onto cover 4 and the latter onto top open end 30 of body 2. Another advantage is the obstruction-free and continuous sampling of the continuous band until the end due to absence of constrictions through opening 5. Yet another advantage is the predetermined pathway inside the body and through opening 5 provided by the shape of the opening, a single mounting means or sleeve 31 placed in alignment with the spool 34 of the continuous band of material 32. These functional features may allow the use of the portable dispensing package in combination with other flexible flat like fabrics of practical use carried by the user.

The above description of the embodiments should not be interpreted in a limiting manner since other variations, modifications and refinements are possible within the spirit and scope of the present invention. By way of example, instead of a sleeve protruding from base 3, the same can alternatively be placed on the rear side of cover 4 near the opening or also conformed to a dent for the insertion into an end portion of the spool hub. Accordingly the scope of the invention is defined in the appended claims and their equivalents.

The invention claimed is:

1. Dispensing package (1) for distributing a continuous band of detachable plastic bags comprising:

a continuous band of detachable plastic bags wound onto a spool hub;

a pair of opposite end walls (3,4) arranged in mutually spaced apart relation by an adjacent closed peripheral wall (2) therebetween, said end walls and said closed peripheral wall delimiting an inner space (8) for storing said continuous band of detachable plastic bags;

an opening (5) arranged on one of said end walls (3,4) for distributing said continuous band of material; said opening (5) is delimited by a pair of edges (9,10) of different radius of curvature and substantially arranged in concentric relationship on one side of the central axis of the package, one of said edges (10) extending parallel to and adjacent the peripheral wall (2) and the other of said edges (9) having a greater radius of curvature than the radius of the one edge and is substantially offset from the central axis, whereby both said edges (9,10) mutually converge to round end distal portions (11,12) with relatively small radii of curvature, whereby the opening provides for a controlled delivery of a desired length of the continuous band of detachable plastic bags without getting stuck at the distal end portions thereof and further minimizes the undesired accumulation of the band of detachable plastic bags in the inner space; and a projection portion (31) which protrudes inwardly from said at least one end wall (3,4) and mounts said spool hub and said continuous band of detachable plastic bags.

2. Dispensing package (1) as defined in claim 1, wherein said continuous band of detachable plastic bags in longitudinal direction comprises a sequence of mutually spaced-apart parallel transverse weakened lines delimiting therebetween a respective detachable portion of said continuous band of detachable plastic bags.

3. Dispensing package as defined in claim 1, wherein said projection portion (31) protruding inwardly from at least one of the said one end walls (3,4) comprises a sleeve means onto which is received an end of said spool hub.

4. Dispensing package as defined in claim 1, wherein said projection portion (31) protruding inwardly from at least one of the said one end walls (3,4) comprises a stem which enters an end of said spool hub.

5. Dispensing package as defined in claim 1 wherein said opening (5) is of substantially semicircular shape with rounded edges.

6. Dispensing package as defined in claim 1, further comprising a hinged lid (6) overlapping said one end wall (4), a chamber (28) therebetween and in communication with the inner space (8) of the dispensing package.

7. Dispensing package as defined in claim 6 wherein the chamber (28) comprises tight engaging means.

8. Dispensing package as defined in claim 1, wherein said opening (5) extends over a circumferential area of about ⅓ of the total circumferential area of said end wall (4).

9. Dispensing package as defined in claim 8 wherein said opening (5) is of substantially semicircular shape with rounded edges.

10. Dispensing package as defined in claim 8, further comprising a hinged lid (6) overlapping said one end wall (4), a chamber (28) therebetween and in communication with the inner space (8) of the dispensing package.

11. Dispensing package as defined in claim 10 wherein the chamber (28) comprises tight engaging means.

12. Dispensing package as defined in claim 8, wherein the cross section shape of said opening (5) is similar to a crescent moon shape.

13. Dispensing package as defined in claim 1, wherein the cross section shape of said opening (5) is similar to a crescent moon shape.

* * * * *